US010490137B2

(12) United States Patent
Fu et al.

(10) Patent No.: US 10,490,137 B2
(45) Date of Patent: Nov. 26, 2019

(54) BACKLIGHT BRIGHTNESS ADJUSTMENT METHOD AND APPARATUS

(71) Applicant: SHENZHEN SKYWORTH-RGB ELECTRONIC CO., LTD., Shenzhen, Guangdong (CN)

(72) Inventors: Huadong Fu, Guangdong (CN); Zhe Huang, Guangdong (CN)

(73) Assignee: SHENZHEN SKYWORTH-RGB ELECTRONIC CO., LTD., Shenzhen (CN)

( * ) Notice: Subject to any disclaimer, the term of this patent is extended or adjusted under 35 U.S.C. 154(b) by 554 days.

(21) Appl. No.: 14/906,562

(22) PCT Filed: Mar. 13, 2015

(86) PCT No.: PCT/CN2015/074172

§ 371 (c)(1),
(2) Date: Jan. 21, 2016

(87) PCT Pub. No.: WO2016/106976

PCT Pub. Date: Jul. 7, 2016

(65) Prior Publication Data

US 2016/0335957 A1 Nov. 17, 2016

(30) Foreign Application Priority Data

Dec. 31, 2014 (CN) ..... 2014 1 0856537

(51) Int. Cl.
*G09G 3/34* (2006.01)
*G09G 3/36* (2006.01)
*G09G 3/20* (2006.01)

(52) U.S. Cl.
CPC ..... *G09G 3/3406* (2013.01); *G09G 3/2018* (2013.01); *G09G 3/36* (2013.01);
(Continued)

(58) Field of Classification Search
None
See application file for complete search history.

(56) References Cited

U.S. PATENT DOCUMENTS 4,962,425 A * 10/1990 Rea ..... G01J 1/00 348/187
5,442,459 A * 8/1995 Gahang ..... H04N 1/4105 358/426.02

(Continued)

FOREIGN PATENT DOCUMENTS

CN 101211537 A 7/2008
CN 101426313 A 5/2009

(Continued)

OTHER PUBLICATIONS

1st Office Action of counterpart Chinese Patent Application No. 201410856537.8 dated May 30, 2016.

(Continued)

*Primary Examiner* — William Boddie
*Assistant Examiner* — Bipin Gyawali

(57) ABSTRACT

Disclosed are a backlight brightness adjustment method and apparatus. The backlight brightness adjustment method includes the following steps: dividing a backlight area of a liquid crystal display (LCD) into multiple sub-areas, acquiring maximum pixel brightness M of each sub-area, and acquiring average pixel brightness A according to the maximum pixel brightness M; classifying the brightness into multiple brightness ranges, and separately adjusting duty cycles and drive currents of a backlight source in different brightness ranges according to the average pixel brightness A and the maximum pixel brightness M; determining, according to the maximum pixel brightness M of each sub-area, a brightness range of the sub-area, and acquiring an adjusted duty cycle and drive current that correspond to the brightness range of each sub-area; and correspondingly (Continued)

controlling illumination brightness of each sub-area by using the adjusted duty cycle and drive current. The present invention improves contrast of an LCD.

12 Claims, 3 Drawing Sheets

(52) U.S. Cl.
CPC . *G09G 2310/0237* (2013.01); *G09G 2310/06* (2013.01); *G09G 2320/0233* (2013.01); *G09G 2320/066* (2013.01); *G09G 2320/0646* (2013.01); *G09G 2330/021* (2013.01)

(56) References Cited

U.S. PATENT DOCUMENTS 6,373,595 B1 * 4/2002 Semba ..... G06T 11/001 345/589
6,388,388 B1 * 5/2002 Weindorf ..... G09G 3/3406 315/157
8,432,352 B2 * 4/2013 Lee ..... G09G 3/3426 345/102
9,179,515 B2 * 11/2015 Aizawa ..... H05B 33/0803
9,763,292 B2 * 9/2017 Kang ..... H05B 33/0815
9,949,342 B2 * 4/2018 Dong ..... H05B 33/0869
9,972,078 B2 * 5/2018 Suzuki ..... G06T 5/009
9,978,316 B2 * 5/2018 Hayashi ..... G09G 3/3406
10,026,366 B2 * 7/2018 Zhang ..... G09G 3/342
10,033,957 B2 * 7/2018 Nishiguchi ..... H04N 7/087
10,062,334 B2 * 8/2018 You ..... G09G 3/3413
10,121,420 B2 * 11/2018 Kato ..... G09G 3/342
2001/0033260 A1 * 10/2001 Nishitani ..... G09G 3/3406 345/87
2004/0246537 A1 * 12/2004 Ohyama ..... H04N 5/202 358/479
2005/0140809 A1 * 6/2005 Lim ..... H04N 5/23203 348/333.01
2005/0206912 A1 * 9/2005 Megawa ..... H04N 1/6072 358/1.1
2006/0056684 A1 * 3/2006 Kurane ..... G06T 5/009 382/162
2006/0109234 A1 * 5/2006 Hong ..... G09G 3/3426 345/102
2006/0208999 A1 * 9/2006 Lee ..... G09G 3/3426 345/102
2007/0152926 A1 * 7/2007 Kwon ..... G09G 3/3426 345/82
2009/0303161 A1 * 12/2009 Messmer ..... G09G 3/14 345/55
2010/0079476 A1 * 4/2010 Baba ..... G09G 3/3406 345/589
2010/0123742 A1 * 5/2010 Jang ..... G09G 3/342 345/690
2010/0328278 A1 * 12/2010 Ishiguro ..... G09G 3/3233 345/205
2011/0043623 A1 * 2/2011 Fukuta ..... G02B 27/0018 348/135
2011/0115829 A1 * 5/2011 Ito ..... G09G 3/3426 345/690
2011/0157262 A1 * 6/2011 Fujiwara ..... G09G 3/3426 345/691
2011/0205442 A1 * 8/2011 Mori ..... G09G 3/3208 348/673
2011/0254873 A1 * 10/2011 Asano ..... G09G 3/3413 345/690
2012/0038694 A1 * 2/2012 Nakanishi ..... G09G 3/3426 345/694
2012/0105515 A1 * 5/2012 Iwasaki ..... G09G 3/3406 345/691
2012/0133684 A1 * 5/2012 Fukase ..... G09G 3/2025 345/690
2012/0169792 A1 * 7/2012 Yamashita ..... G02F 1/1336 345/690
2012/0176397 A1 * 7/2012 Mizukoshi ..... G09G 3/3233 345/589
2013/0094765 A1 * 4/2013 Liu ..... H04N 1/38 382/199
2013/0155125 A1 * 6/2013 Inamura ..... G09G 5/10 345/690
2013/0265348 A1 * 10/2013 Onogi ..... G09G 5/10 345/691
2014/0049527 A1 * 2/2014 Lanzoni ..... G09G 3/36 345/207
2014/0204131 A1 * 7/2014 Chen ..... G09G 3/36 345/691
2014/0292634 A1 * 10/2014 Kita ..... G09G 3/342 345/102
2014/0340437 A1 * 11/2014 Kohashikawa ..... G06F 3/1446 345/694
2015/0103105 A1 * 4/2015 Kim ..... G09G 3/2092 345/690
2015/0116379 A1 * 4/2015 Lim ..... G09G 3/3406 345/691
2015/0235587 A1 * 8/2015 Su ..... G09G 3/2003 345/694
2015/0365621 A1 * 12/2015 Zhang ..... G09G 5/005 348/791
2016/0247445 A1 * 8/2016 Zhang ..... G09G 3/3225
2016/0260390 A1 * 9/2016 Diao ..... G09G 3/3406
2016/0293115 A1 * 10/2016 Yamashita ..... G09G 3/3406
2017/0092176 A1 * 3/2017 Liu ..... G09G 3/2003
2017/0236490 A1 * 8/2017 Cheon ..... G09G 5/10 345/691
2017/0249890 A1 * 8/2017 Yoo ..... G09G 3/2074
2018/0075813 A1 * 3/2018 Zhang ..... G09G 3/34

FOREIGN PATENT DOCUMENTS

CN 102013239 A 4/2011
CN 102262866 A 11/2011

OTHER PUBLICATIONS

International Search Report of PCT Patent Application No. PCT/CN2015/074172 dated Sep. 18, 2015.
International Search Report of PCT Patent Application No. PCT/CN2015/014172 dated Sep. 18, 2015.

* cited by examiner

BACKLIGHT BRIGHTNESS ADJUSTMENT METHOD AND APPARATUS

BACKGROUND

Technical Field

The present invention relates to the field of liquid crystal backlight technologies, and in particular, to a backlight brightness adjustment method and an apparatus.

Related Art

A liquid crystal display (LCD) is a passive luminous body, and a light-emitting diode (LED) backlight source that is located at the back of the LCD emits light. The LED backlight source is high in luminous efficiency, has a flexible combination manner, and is widely applied in liquid crystal flat screen televisions.

Currently, for a direct LED backlight source, brightness of each LED may be dynamically adjusted by using an area dimming algorithm, to achieve an objective of energy saving and enhancing dynamic contrast of an image. A conventional area dimming algorithm is to remain a maximum current unchanged, and control a PWM duty cycle value according to brightness content of a frame. In such a method, because backlight brightness of an LED cannot reach a maximum value most of the time, the method for dynamically improving contrast based on an area dimming algorithm still has some limitations, and due to a limitation on contrast improvement, a display effect of an LCD is still not desired, and a viewing effect is affected.

The foregoing content is merely intended to help understand the technical solutions of the present invention, but does not indicate an agreement that the foregoing content belongs to the prior art.

SUMMARY

A main objective of the present invention is to provide a backlight brightness adjustment method and apparatus, so as to resolve a technical problem that a display effect is not desired due to a limitation of improving contrast of an LCD based on an area dimming algorithm.

In order to achieve the foregoing objective, the present invention provides a backlight brightness adjustment method, where the backlight brightness adjustment method includes the following steps:

dividing a backlight area of an LCD into multiple sub-areas, acquiring maximum pixel brightness M of each sub-area, and acquiring average pixel brightness A according to the maximum pixel brightness M;

classifying the brightness into multiple brightness ranges, and separately adjusting duty cycles and drive currents of a backlight source in different brightness ranges according to the average pixel brightness A and the maximum pixel brightness M;

determining, according to the maximum pixel brightness M of each sub-area, a brightness range of the sub-area, and acquiring an adjusted duty cycle and drive current that correspond to the brightness range of each sub-area; and correspondingly controlling illumination brightness of each sub-area by using the adjusted duty cycle and drive current.

Preferably, the step of dividing a backlight area of an LCD into multiple sub-areas, acquiring maximum pixel brightness M of each sub-area, and acquiring average pixel brightness A according to the maximum pixel brightness M includes:

dividing the backlight area of the LCD into the multiple sub-areas, detecting pixel brightness of each sub-area, and acquiring maximum pixel brightness M of an LED in each sub-area according to an input frame; and summing up the maximum pixel brightness M of all the sub-areas and calculating an average value, and using the average value as the average pixel brightness A.

Preferably, the brightness ranges include a first brightness range, a second brightness range, and a third brightness range; brightness in the first brightness range, the second brightness range, and the third brightness range progressively increases; and the step of classifying the brightness into multiple brightness ranges, and separately adjusting duty cycles and drive currents of a backlight source in different brightness ranges according to the average pixel brightness A and the maximum pixel brightness M includes:

adjusting the duty cycles of the backlight source in the different brightness ranges according to the average pixel brightness A and the maximum pixel brightness M by using a first algorithm; and adjusting the drive currents of the backlight source in the different brightness ranges according to the average pixel brightness A and the maximum pixel brightness M by using a second algorithm.

Preferably, the step of adjusting the duty cycles of the backlight source in the different brightness ranges according to the average pixel brightness A and the maximum pixel brightness M by using a first algorithm includes:

in the first brightness range, setting a first duty cycle P1 of the backlight source to be equal to B1*(M+f(A)), where B1 is a first duty cycle adjustment coefficient, and B1>1;

in the second brightness range, setting a second duty cycle P2 of the backlight source to be equal to B2*M, where B2 is a second duty cycle adjustment coefficient, and 1<B2<2; and in the third brightness range, setting a third duty cycle P3 of the backlight source to be a maximum duty cycle of the backlight source.

Preferably, when an input frame is a 100% dark burst frame, the backlight source is turned off, where the first duty cycle P1 of the backlight source is equal to 0.

Preferably, the step of adjusting the drive currents of the backlight source in the different brightness ranges according to the average pixel brightness A and the maximum pixel brightness M by using a second algorithm includes:

in the first brightness range, setting a first drive current I1 of the backlight source to be a maximum drive current I of the backlight source; and in the second brightness range, setting a second drive current I2 of the backlight source to be equal to C1*I+f(M, A), where C1 is a first current adjustment coefficient, 0<C1<1, and f(M, A)>0; and in the third brightness range, setting a third drive current I3 of the backlight source to be equal to I+f(M, A), where f(M, A)≤0.

Preferably, when the illumination brightness of each sub-area is controlled by using the adjusted duty cycle, the adjusted duty cycle is stored in at least one drive IC register, and a waveform signal corresponding to the duty cycle is output by using the drive IC register to control the illumination brightness of each sub-area.

In addition, in order to achieve the foregoing objective, the present invention further provides a backlight brightness adjustment apparatus, where the apparatus includes:

an acquiring module, configured to divide a backlight area of an LCD into multiple sub-areas, acquire maximum pixel brightness M of each sub-area, and acquire average pixel brightness A according to the maximum pixel brightness M;

an adjustment module, configured to classify the brightness into multiple brightness ranges, and separately adjust duty cycles and drive currents of a backlight source in different brightness ranges according to the average pixel brightness A and the maximum pixel brightness M;

a determining module, configured to determine, according to the maximum pixel brightness M of each sub-area, a brightness range of the sub-area, and acquire an adjusted duty cycle and drive current that correspond to the brightness range of each sub-area; and a control module, configured to correspondingly control illumination brightness of each sub-area by using the adjusted duty cycle and drive current.

Preferably, the acquiring module is specifically configured to divide the backlight area of the LCD into the multiple sub-areas, detect pixel brightness of each sub-area, and acquire maximum pixel brightness M of an LED in each sub-area according to an input frame; and sum up the maximum pixel brightness M of all the sub-areas and calculate an average value, and use the average value as the average pixel brightness A.

Preferably, the brightness ranges include a first brightness range, a second brightness range, and a third brightness range; brightness in the first brightness range, the second brightness range, and the third brightness range progressively increases; and the adjustment module includes:

a duty cycle adjustment unit, configured to adjust the duty cycles of the backlight source in the different brightness ranges according to the average pixel brightness A and the maximum pixel brightness M by using a first algorithm; and a drive current adjustment unit, configured to adjust the drive currents of the backlight source in the different brightness ranges according to the average pixel brightness A and the maximum pixel brightness M by using a second algorithm.

Preferably, the duty cycle adjustment unit includes:

a first adjustment subunit, configured to: in the first brightness range, set a first duty cycle P1 of the backlight source to be equal to B1*(M+f(A)), where B1 is a first duty cycle adjustment coefficient, and B1>1;

a second adjustment subunit, configured to: in the second brightness range, set a second duty cycle P2 of the backlight source to be equal to B2*M, where B2 is a second duty cycle adjustment coefficient, and 1<B2<2; and a third adjustment subunit, configured to: in the third brightness range, set a third duty cycle P3 of the backlight source to be a maximum duty cycle of the backlight source.

Preferably, the first adjustment subunit is further configured to: when an input frame is a 100% dark burst frame, turn off the backlight source, where the first duty cycle P1 of the backlight source is equal to 0.

Preferably, the drive current adjustment unit includes:

a fourth adjustment subunit, configured to: in the first brightness range, set a first drive current I1 of the backlight source to be a maximum drive current I of the backlight source;

a fifth adjustment subunit, configured to: in the second brightness range, set a second drive current I2 of the backlight source to be equal to C1*I+f(M, A), where C1 is a first current adjustment coefficient, 0<C1<1, and f(M, A)>0; and a sixth adjustment subunit, configured to: in the third brightness range, set a third drive current I3 of the backlight source to be equal to I+f(M, A), where f(M, A)≤0.

Preferably, the control module is specifically configured to: when controlling the illumination brightness of each sub-area by using the adjusted duty cycle, store the adjusted duty cycle in at least one drive IC register, and output, by using the drive IC register, a waveform signal corresponding to the duty cycle to control the illumination brightness of each sub-area.

The present invention provides a backlight brightness adjustment method and apparatus, where a backlight area of an LCD is divided into multiple sub-areas, brightness is divided into multiple brightness ranges, and then, a duty cycle and a drive current of a backlight source are dynamically adjusted according to maximum pixel brightness M and average pixel brightness A of each sub-area, to control illumination brightness of each sub-area; in this way, the duty cycle and the drive current of the backlight source can be dynamically adjusted according to a current frame, so as to enlarge a range of illumination brightness of an LED of the backlight source, further improve contrast, and enhance a display effect.

Implementation, functional characteristics, and advantages of the objective of the present invention are further described in combination with embodiments and with reference to the accompanying drawings.

DETAILED DESCRIPTION

It should be appreciated that specific embodiments described herein are merely used to explain the present invention, and are not intended to limit the present invention.

Figure 1:
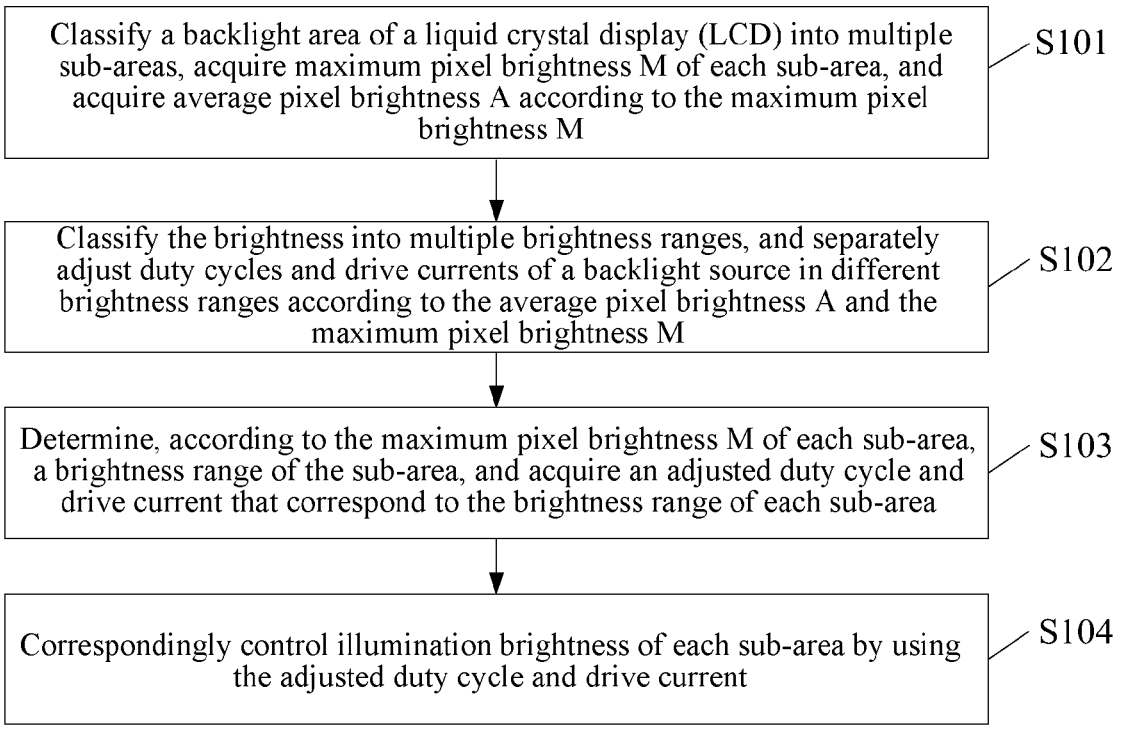
FIG. 1 is a schematic flowchart of an embodiment of a backlight brightness adjustment method according to the present invention.

The present invention provides a backlight brightness adjustment method. Referring to FIG. 1, in an embodiment, the backlight brightness adjustment method includes:

Step S101: Divide a backlight area of an LCD into multiple sub-areas, acquire maximum pixel brightness M of each sub-area, and acquire average pixel brightness A according to the maximum pixel brightness M.

In this embodiment, the backlight area of the LCD is divided into several sub-areas of a same size, and for an LED light in each sub-area obtained through classification, the maximum pixel brightness M of each sub-area is acquired according to a transmitted frame. In this embodiment, pixel brightness of each sub-area is detected, to obtain the maximum pixel brightness M of each sub-area, and then, the maximum pixel brightness M of all the sub-areas is summed up and an average value is calculated, where the average value is the average pixel brightness A.

In this embodiment, the backlight area of the LCD is divided into the multiple sub-areas, so as to separately control backlight brightness of the multiple sub-areas.

Step S102: Classify the brightness into multiple brightness ranges, and separately adjust duty cycles and drive currents of a backlight source in different brightness ranges according to the average pixel brightness A and the maximum pixel brightness M.

In this embodiment, the brightness is divided into the multiple brightness ranges. Using an 8-bit grayscale as an example for description, in grayscales 0 to 255, two grayscales a1 and a2 (a1<a2) in the middle are taken, 0 to a1 is classified into a low brightness range, a1 to a2 is classified into a moderate brightness range, and a2 to 255 is classified into a high brightness range. This embodiment is not limited to the foregoing brightness classification manner, and classification may also be performed in another manner.

In this embodiment, the duty cycles of the backlight source in the different brightness ranges are separately adjusted according to the average pixel brightness A and the maximum pixel brightness M. As described above, if the brightness is classified into three brightness ranges, duty cycles corresponding to the three brightness ranges are separately adjusted, and gain curves of the duty cycles corresponding to the three brightness range are made continuous; and drive currents corresponding to the three brightness ranges are separately adjusted according to a luminous characteristic of an LED, and current curves corresponding to the three brightness range are made continuous.

In this embodiment, the duty cycles and the drive currents of the backlight source in the different brightness ranges are separately adjusted according to the average pixel brightness A and the maximum pixel brightness M, that is, a duty cycle and a drive current of the backlight source can be dynamically adjusted according to a current frame of the LCD, so as to enlarge a range of illumination brightness of the LED and further improve contrast.

Step S103: Determine, according to the maximum pixel brightness M of each sub-area, a brightness range of the sub-area, and acquire an adjusted duty cycle and drive current that correspond to the brightness range of each sub-area.

In this embodiment, the brightness range of each sub-area is determined according to the maximum pixel brightness M of the sub-area, it is determined whether each sub-area belongs to a low brightness range, a moderate brightness range, or a high brightness range, and then, a corresponding adjusted duty cycle and drive current are acquired according to the brightness range of each sub-area.

In this embodiment, the brightness is classified into the multiple brightness ranges, and the brightness range of each sub-area is determined, so as to separately control backlight brightness of sub-areas in the different brightness ranges.

Step S104: Correspondingly control illumination brightness of each sub-area by using the adjusted duty cycle and drive current.

In this embodiment, when the illumination brightness of each sub-area is controlled by using the adjusted duty cycle, the adjusted duty cycle is stored in at least one drive IC register, and a waveform signal corresponding to the duty cycle is output by using the drive IC register to control the illumination brightness of each sub-area.

Further, when a rising edge of a vertical synchronization signal VSYNC generated by a master IC of the LCD comes, the master IC starts to acquire image information and send the image information to a processor by using an SPI interface, and the processor adjusts a duty cycle of the image information, and stores an adjusted duty cycle in one driver or multiple IC registers, so that the IC registers output waveform signals with different duty cycles, to control illumination brightness of an LED, thereby controlling display brightness of each sub-area.

In this embodiment, not only is a duty cycle dynamically adjusted according to frame brightness of each sub-area, but also a drive current of an LED is dynamically adjusted according to a luminous characteristic of the LED, so that the backlight source can also be expanded in a dark scene, and in a bright scene, brightness can be improved in a short time; in this way, a dynamic brightness range can be enlarged, contrast of a dynamic frame is further improved, and a display effect is enhanced.

Compared with the prior art, in this embodiment, a backlight area of an LCD is divided into multiple sub-areas, brightness is divided into multiple brightness ranges, and then, a duty cycle and a drive current of a backlight source are dynamically adjusted according to maximum pixel brightness M and average pixel brightness A of each sub-area, to control illumination brightness of each sub-area; in this way, the duty cycle and the drive current of the backlight source can be dynamically adjusted according to a current frame, so as to enlarge a range of illumination brightness of an LED of the backlight source, further improve contrast, and enhance a display effect.

Figure 2:
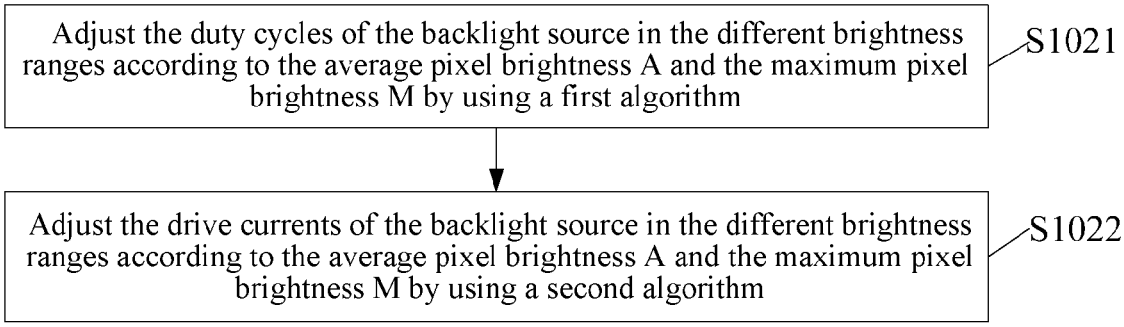
FIG. 2 is a detailed schematic flowchart of step S102 in FIG. 1.

In a preferred embodiment, as shown in FIG. 2, based on the embodiment shown in FIG. 1, step S102 includes:

Step S1021: Adjust the duty cycles of the backlight source in the different brightness ranges according to the average pixel brightness A and the maximum pixel brightness M by using a first algorithm.

Step S1022: Adjust the drive currents of the backlight source in the different brightness ranges according to the average pixel brightness A and the maximum pixel brightness M by using a second algorithm.

In this embodiment, the brightness ranges obtained through classification preferably include a first brightness range, a second brightness range, and a third brightness range; brightness in the first brightness range, the second brightness range, and the third brightness range progressively increases; and it may also be understood as that the brightness ranges preferably include a low brightness range, a moderate brightness range, and a high brightness range. When duty cycles and drive currents of the backlight source in the first brightness range, the second brightness range, and the third brightness range are adjusted by using the first algorithm, in the first brightness range, the duty cycle is made to have a gain, and improving the drive current in such a manner helps improve contrast; in the second brightness range, the duty cycle is made nonlinear, and more uniform grayscale distribution indicates a smaller drive current; in this way, a voltage of a drive circuit is decreased; therefore, power consumption is decreased; and in the third brightness range, the duty cycle is made constant, and more uniform grayscale distribution indicates a more bright frame and fewer frame details; therefore, the drive current needs to be reduced, so that the voltage of the drive circuit is also decreased, and power consumption is decreased.

In a preferred embodiment, step S1021 in the foregoing embodiment in FIG. 2, that is, the step of adjusting the duty cycles of the backlight source in the different brightness ranges according to the average pixel brightness A and the maximum pixel brightness M by using a first algorithm, includes:

in the first brightness range, setting a first duty cycle P1 of the backlight source to be equal to B1*(M+f(A)), where B1 is a first duty cycle adjustment coefficient, B1>1, f(A) is a correction function using the average pixel brightness A as a variable, and when a frame of an input image is an 100% dark burst frame, backlight is required to be turned off, so that a duty cycle of a corresponding sub-area is 0;

in the second brightness range, setting a second duty cycle P2 of the backlight source to be equal to B2*M, where B2 is a second duty cycle adjustment coefficient, and 1<B2<2; and in the third brightness range, setting a third duty cycle P3 of the backlight source to be a maximum duty cycle of the backlight source.

In this embodiment, values of the first duty cycle adjustment coefficient B1, the second duty cycle adjustment coefficient B2, and the correction function f(A) are adjusted and configured, so that the gain curves of the duty cycles of the first brightness range, the second brightness range, and the third brightness range are continuous.

Figure 3:
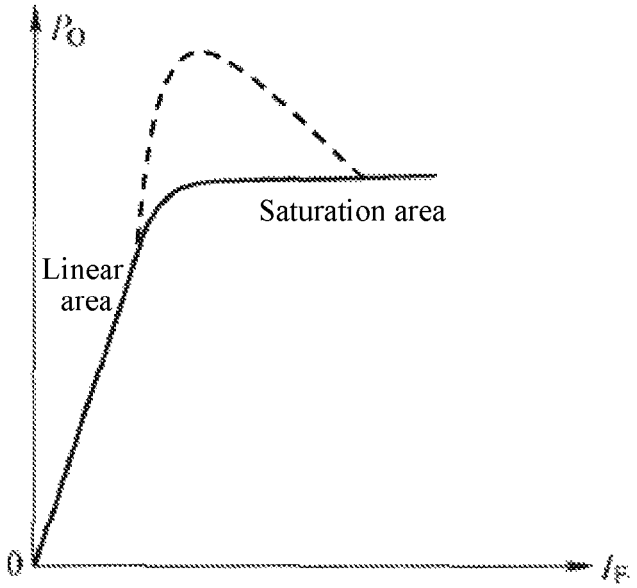
FIG. 3 is a schematic diagram of a curve of luminous power and a current of a light-emitting diode.

In a preferred embodiment, with reference to FIG. 3, FIG. 3 is a schematic diagram of a luminous characteristic of an LED, where a horizontal coordinate is a drive current value, a vertical coordinate is luminous power (higher luminous power indicates a larger brightness value). With a given direct drive current, after the LED works, the LED reaches a saturation area very quickly and remains stable, and illumination brightness remains constant. That is, if the luminous characteristic of the LED is inputting different current values, illumination brightness is different. If a current that exceeds a rated value is input, illumination brightness of the LED exceeds brightness in a rated state in a short time, and then, falls back to the saturation area slowly, and the illumination brightness remains constant. The drive current of the backlight source can be adjusted by using the characteristic of the LED. Step S1022 in the foregoing embodiment in FIG. 2, that is, the step of adjusting the drive currents of the backlight source in the different brightness ranges according to the average pixel brightness A and the maximum pixel brightness M by using a second algorithm, includes:

in the first brightness range, setting a first drive current I1 of the backlight source to be a maximum drive current I of the backlight source, where the maximum drive current I is a maximum current value in a specification;

in the second brightness range, setting a second drive current I2 of the backlight source to be equal to C1*I+f(M, A), where C1 is a first current adjustment coefficient, 0<C1<1, f(M, A)>0, f(M, A) is a function using the average pixel brightness A and the maximum pixel brightness M as variables, and a larger difference between maximum pixel brightness M and average pixel brightness A of a frame of a sub-area indicates more discrete grayscale distribution of the sub-area and larger C1 and f(M, A); otherwise, a smaller difference between maximum pixel brightness M and average pixel brightness A of a frame of a sub-area indicates more uniform grayscale distribution of the sub-area and smaller C1 and f(M, A); and in the third brightness range, setting a third drive current I3 of the backlight source to be equal to I+f(M, A), where f(M, A)≤0, f(M, A) is also function using the average pixel brightness A and the maximum pixel brightness M as variables with a difference in a value range, a larger difference between maximum pixel brightness M and average pixel brightness A of a frame of a sub-area indicates more discrete grayscale distribution of the sub-area and larger f(M, A); otherwise, f(M, A) is smaller.

In this embodiment, values of the first current adjustment coefficient C1 and f(M, A) are adjusted and configured, so that the current curves of the first brightness range, the second brightness range, and the third brightness range are continuous.

Figure 4:
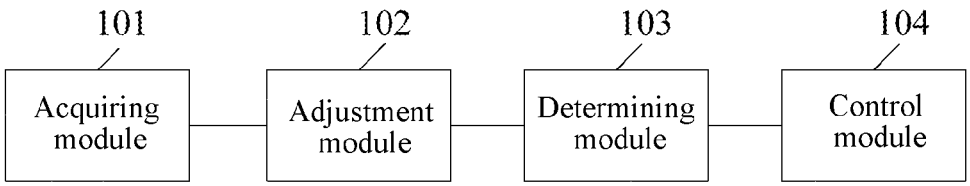
FIG. 4 is a schematic diagram of functional modules in an embodiment of a backlight brightness adjustment apparatus according to the present invention.

The present invention further provides a backlight brightness adjustment apparatus. As shown in FIG. 4, in an embodiment, the apparatus includes an acquiring module 101, an adjustment module 102, a determining module 103, and a control module 104.

The acquiring module 101 is configured to divide a backlight area of an LCD into multiple sub-areas, acquire maximum pixel brightness M of each sub-area, and acquire average pixel brightness A according to the maximum pixel brightness M;

In this embodiment, the backlight area of the LCD is divided into several sub-areas of a same size, and for an LED light in each sub-area obtained through classification, the maximum pixel brightness M of each sub-area is acquired according to a transmitted frame. In this embodiment, pixel brightness of each sub-area is detected, to obtain the maximum pixel brightness M of each sub-area, and then, the maximum pixel brightness M of all the sub-areas is summed up and an average value is calculated, where the average value is the average pixel brightness A.

In this embodiment, the backlight area of the LCD is divided into the multiple sub-areas, so as to separately control backlight brightness of the multiple sub-areas.

The adjustment module 102 is configured to classify the brightness into multiple brightness ranges, and separately adjust duty cycles and drive currents of a backlight source in different brightness ranges according to the average pixel brightness A and the maximum pixel brightness M.

In this embodiment, the brightness is divided into the multiple brightness ranges. Using an 8-bit grayscale as an example for description, in grayscales 0 to 255, two grayscales a1 and a2 (a1<a2) in the middle are taken, 0 to a1 is classified into a low brightness range, a1 to a2 is classified into a moderate brightness range, and a2 to 255 is classified into a high brightness range. This embodiment is not limited to the foregoing brightness classification manner, and classification may also be performed in another manner.

In this embodiment, the duty cycles of the backlight source in the different brightness ranges are separately adjusted according to the average pixel brightness A and the maximum pixel brightness M. As described above, if the brightness is classified into three brightness ranges, duty cycles corresponding to the three brightness ranges are separately adjusted, and gain curves of the duty cycles corresponding to the three brightness range are made continuous; and drive currents corresponding to the three brightness ranges are separately adjusted according to a luminous characteristic of an LED, and current curves corresponding to the three brightness range are made continuous.

In this embodiment, the duty cycles and the drive currents of the backlight source in the different brightness ranges are separately adjusted according to the average pixel brightness A and the maximum pixel brightness M, that is, a duty cycle and a drive current of the backlight source can be dynamically adjusted according to a current frame of the LCD, so as to enlarge a range of illumination brightness of the LED and further improve contrast.

The determining module 103 is configured to determine, according to the maximum pixel brightness M of each sub-area, a brightness range of the sub-area, and acquire an adjusted duty cycle and drive current that correspond to the brightness range of each sub-area.

In this embodiment, the brightness range of each sub-area is determined according to the maximum pixel brightness M of the sub-area, it is determined whether each sub-area belongs to a low brightness range, a moderate brightness range, or a high brightness range, and then, a corresponding adjusted duty cycle and drive current are acquired according to the brightness range of each sub-area.

In this embodiment, the brightness is classified into the multiple brightness ranges, and the brightness range of each sub-area is determined, so as to separately control backlight brightness of sub-areas in the different brightness ranges.

The control module 104 is configured to correspondingly control illumination brightness of each sub-area by using the adjusted duty cycle and drive current.

In this embodiment, when the illumination brightness of each sub-area is controlled by using the adjusted duty cycle, the adjusted duty cycle is stored in at least one drive IC register, and a waveform signal corresponding to the duty cycle is output by using the drive IC register to control the illumination brightness of each sub-area.

Further, when a rising edge of a vertical synchronization signal VSYNC generated by a master IC of the LCD comes, the master IC starts to acquire image information and send the image information to a processor by using an SPI interface, and the processor adjusts a duty cycle of the image information, and stores an adjusted duty cycle in one driver or multiple IC registers, so that the IC registers output waveform signals with different duty cycles, to control illumination brightness of an LED, thereby controlling display brightness of each sub-area.

In this embodiment, not only is a duty cycle dynamically adjusted according to frame brightness of each sub-area, but also a drive current of an LED is dynamically adjusted according to a luminous characteristic of the LED, so that the backlight source can also be expanded in a dark scene, and in a bright scene, brightness can be improved in a short time;

in this way, a dynamic brightness range can be enlarged, contrast of a dynamic frame is further improved, and a display effect is enhanced.

Figure 5:
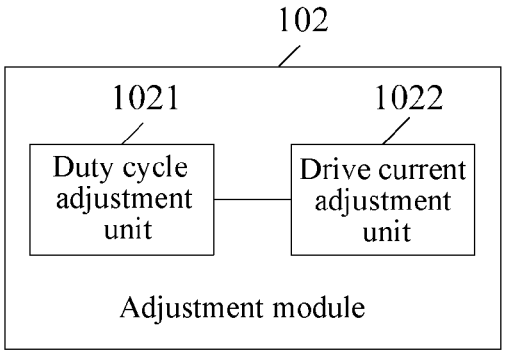
FIG. 5 is a detailed schematic diagram of functional modules in an adjustment module in FIG. 4.

In a preferred embodiment, as shown in FIG. 5, based on the embodiment shown in FIG. 4, the adjustment module 102 includes:

a duty cycle adjustment unit 1021, configured to adjust the duty cycles of the backlight source in the different brightness ranges according to the average pixel brightness A and the maximum pixel brightness M by using a first algorithm; and a drive current adjustment unit 1022, configured to adjust the drive currents of the backlight source in the different brightness ranges according to the average pixel brightness A and the maximum pixel brightness M by using a second algorithm.

In this embodiment, the brightness ranges obtained through classification preferably include a first brightness range, a second brightness range, and a third brightness range; brightness in the first brightness range, the second brightness range, and the third brightness range progressively increases; and it may also be understood as that the brightness ranges preferably include a low brightness range, a moderate brightness range, and a high brightness range. When duty cycles and drive currents of the backlight source in the first brightness range, the second brightness range, and the third brightness range are adjusted by using the first algorithm, in the first brightness range, the duty cycle is made to have a gain, and improving the drive current in such a manner helps improve contrast; in the second brightness range, the duty cycle is made nonlinear, and more uniform grayscale distribution indicates a smaller drive current; in this way, a voltage of a drive circuit is decreased; therefore, power consumption is decreased; and in the third brightness range, the duty cycle is made constant, and more uniform grayscale distribution indicates a more bright frame and fewer frame details; therefore, the drive current needs to be reduced, so that the voltage of the drive circuit is also decreased, and power consumption is decreased.

In a preferred embodiment, in the foregoing embodiment in FIG. 5, the duty cycle adjustment unit 1021 includes:

a first adjustment subunit, configured to: in the first brightness range, set a first duty cycle P1 of the backlight source to be equal to B1*(M+f(A)), where B1 is a first duty cycle adjustment coefficient, B1>1, f(A) is a correction function using the average pixel brightness A as a variable, and when a frame of an input image is an 100% dark burst frame, backlight is required to be turned off, so that a duty cycle of a corresponding sub-area is 0;

a second adjustment subunit, configured to: in the second brightness range, set a second duty cycle P2 of the backlight source to be equal to B2*M, where B2 is a second duty cycle adjustment coefficient, and 1<B2<2; and a third adjustment subunit, configured to: in the third brightness range, set a third duty cycle P3 of the backlight source to be a maximum duty cycle of the backlight source.

In this embodiment, values of the first duty cycle adjustment coefficient B1, the second duty cycle adjustment coefficient B2, and the correction function f(A) are adjusted and configured, so that the gain curves of the duty cycles of the first brightness range, the second brightness range, and the third brightness range are continuous.

In a preferred embodiment, with reference to FIG. 3, FIG. 3 is a schematic diagram of a luminous characteristic of an LED. With a given direct drive current, after the LED works, the LED reaches a saturation area very quickly and remains stable, and illumination brightness remains constant. That is, if the luminous characteristic of the LED is inputting different current values, illumination brightness is different. If a current that exceeds a rated value is input, illumination brightness of the LED exceeds brightness in a rated state in a short time, and then, falls back to the saturation area slowly, and the illumination brightness remains constant. The drive current of the backlight source can be adjusted by using the characteristic of the LED. In the foregoing embodiment in FIG. 5, the drive current adjustment unit 1022 includes:

a fourth adjustment subunit, configured to: in the first brightness range, set a first drive current I1 of the backlight source to be a maximum drive current I of the backlight source, where the maximum drive current I is a maximum current value in a specification;

a fifth adjustment subunit, configured to: in the second brightness range, set a second drive current I2 of the backlight source to be equal to C1*I+f(M, A), where C1 is a first current adjustment coefficient, 0<C1<1, f(M, A)>0, f(M, A) is a function using the average pixel brightness A and the maximum pixel brightness M as variables, and a larger difference between maximum pixel brightness M and average pixel brightness A of a frame of a sub-area indicates more discrete grayscale distribution of the sub-area and larger C1 and f(M, A); otherwise, a smaller difference between maximum pixel brightness M and average pixel brightness A of a frame of a sub-area indicates more uniform grayscale distribution of the sub-area and smaller C1 and f(M, A); and a sixth adjustment subunit, configured to: in the third brightness range, set a third drive current I3 of the backlight source to be equal to I+f(M, A), where f(M, A)≤0, f(M, A) is also function using the average pixel brightness A and the maximum pixel brightness M as variables with a difference in a value range, a larger difference between maximum pixel brightness M and average pixel brightness A of a frame of a sub-area indicates more discrete grayscale distribution of the sub-area and larger f(M, A); otherwise, f(M, A) is smaller.

In this embodiment, values of the first current adjustment coefficient C1 and f(M, A) are adjusted and configured, so that the current curves of the first brightness range, the second brightness range, and the third brightness range are continuous.

The foregoing descriptions are merely preferred embodiments of the present invention but are not intended to limit the patent scope of the present invention. Any equivalent modifications made to the structures or processes based on the content of the specification and the accompanying drawings of the present invention for direct or indirect use in other relevant technical fields shall also be encompassed in the patent protection scope of the present invention.

What is claimed is:

1. A backlight brightness adjustment method, wherein the backlight brightness adjustment method comprises the following steps:

dividing a backlight area of a liquid crystal display (LCD) into multiple sub-areas, acquiring maximum pixel brightness M of each sub-area, and acquiring average pixel brightness A according to the maximum pixel brightness M;

classifying the brightness into multiple brightness ranges, wherein, the brightness ranges comprise a first brightness range, a second brightness range, and a third brightness range, brightness in the first brightness range, the second brightness range, and the third brightness range progressively increase;

adjusting the duty cycles of the backlight source in the different brightness ranges according to the average pixel brightness A and the maximum pixel brightness M by using a first algorithm; and adjusting the drive currents of the backlight source in the different brightness ranges according to the average pixel brightness A, the maximum pixel brightness M, and a maximum drive current of the backlight source by using a second algorithm;

determining, according to the maximum pixel brightness M of each sub-area, a brightness range of the sub-area, and acquiring an adjusted duty cycle and drive current that correspond to the brightness range of each sub-area; and correspondingly controlling illumination brightness of each sub-area by using the adjusted duty cycle and drive current;

wherein, the operation of adjusting the drive currents of the backlight source in the different brightness ranges according to the average pixel brightness A, the maximum pixel brightness M, and a maximum drive current of the backlight source by using a second algorithm comprises:

in the first brightness range, setting a first drive current I1 of the backlight source to be the maximum drive current I of the backlight source;

in the second brightness range, setting a second drive current I2 of the backlight source to be equal to C1*I+f1(M, A), wherein C1 is a first current adjustment coefficient, 0<C1<1, f1(M, A) is a function using the average pixel brightness A and the maximum pixel brightness M as variables, and f1(M, A)>0; and in the third brightness range, setting a third drive current I3 of the backlight source to be equal to I+f2(M, A), wherein f2(M, A) is a function using the average pixel brightness A and the maximum pixel brightness M as variables, and f2(M, A)≤0.

2. A backlight brightness adjustment apparatus, wherein the apparatus comprises a processor and a memory coupled to the processor, the memory stores programmed instruction units executable by the processor and comprises:

an acquiring module, configured to divide a backlight area of a liquid crystal display (LCD) into multiple sub-areas, acquire maximum pixel brightness M of each sub-area, and acquire average pixel brightness A according to the maximum pixel brightness M;

an adjustment module, configured to classify the brightness into multiple brightness ranges, and separately adjust duty cycles and drive currents of a backlight source in different brightness ranges according to the average pixel brightness A and the maximum pixel brightness M;

a determining module, configured to determine, according to the maximum pixel brightness M of each sub-area, a brightness range of the sub-area, and acquire an adjusted duty cycle and drive current that correspond to the brightness range of each sub-area; and a control module, configured to correspondingly control illumination brightness of each sub-area by using the adjusted duty cycle and drive current;

wherein the brightness ranges comprise a first brightness range, a second brightness range, and a third brightness range; brightness in the first brightness range, the second brightness range, and the third brightness range progressively increases; and the adjustment module comprises:

a duty cycle adjustment unit, configured to adjust the duty cycles of the backlight source in the different brightness ranges according to the average pixel brightness A and the maximum pixel brightness M by using a first algorithm; and a drive current adjustment unit, configured to adjust the drive currents of the backlight source in the different brightness ranges according to the average pixel brightness A, the maximum pixel brightness M, and a maximum drive current of the backlight source by using a second algorithm;

wherein, the drive current adjustment unit comprises:

a fourth adjustment subunit, configured to: in the first brightness range, set a first drive current I1 of the backlight source to be the maximum drive current I of the backlight source;

a fifth adjustment subunit, configured to: in the second brightness range, set a second drive current I2 of the backlight source to be equal to C1*I+f1(M, A), wherein C1 is a first current adjustment coefficient, 0<C1<1, f1(M, A) is a function using the average pixel brightness A and the maximum pixel brightness M as variables, and f1(M, A)>0; and a sixth adjustment subunit, configured to: in the third brightness range, set a third drive current I3 of the backlight source to be equal to I+f2(M, A), wherein f2(M, A) is a function using the average pixel brightness A and the maximum pixel brightness M as variables, f2(M, A)≤0.

3. The backlight brightness adjustment method according to claim 1, wherein, the operation of adjusting the duty cycles of the backlight source in the different brightness ranges according to the average pixel brightness A and the maximum pixel brightness M by using a first algorithm comprises:

in the first brightness range, setting a first duty cycle P1 of the backlight source to be equal to B1*(M+f(A)), wherein B1 is a first duty cycle adjustment coefficient, and B1>1, f(A) is a correction function using the average pixel brightness A as a variable.

4. The backlight brightness adjustment method according to claim 3, wherein, the operation of adjusting the duty cycles of the backlight source in the different brightness ranges according to the average pixel brightness A and the maximum pixel brightness M by using a first algorithm further comprises:

in the second brightness range, setting a second duty cycle P2 of the backlight source to be equal to B2*M, wherein B2 is a second duty cycle adjustment coefficient, and 1<B2<2; and in the third brightness range, setting a third duty cycle P3 of the backlight source to be a maximum duty cycle of the backlight source.

5. The backlight brightness adjustment method according to claim 4, wherein, when an input frame is a 100% dark burst frame, the backlight source is turned off, wherein the first duty cycle P1 of the backlight source is equal to 0.

6. The backlight brightness adjustment method according to claim 1, wherein, the operation of dividing a backlight area of an LCD into multiple sub-areas, acquiring maximum pixel brightness M of each sub-area, and acquiring average pixel brightness A according to the maximum pixel brightness M comprises:

dividing the backlight area of the LCD into the multiple sub-areas, detecting pixel brightness of each sub-area, and acquiring maximum pixel brightness M of a light-emitting diode (LED) in each sub-area according to an input frame; and summing up the maximum pixel brightness M of all the sub-areas and calculating an average value, and using the average value as the average pixel brightness A.

7. The backlight brightness adjustment method according to claim 6, wherein, when the illumination brightness of each sub-area is controlled by using the adjusted duty cycle, the adjusted duty cycle is stored in at least one drive IC register, and a waveform signal corresponding to the duty cycle is output by using the drive IC register to control the illumination brightness of each sub-area.

8. The backlight brightness adjustment apparatus according to claim 2, wherein, the duty cycle adjustment unit comprises:

a first adjustment subunit, configured to: in the first brightness range, set a first duty cycle P1 of the backlight source to be equal to B1*(M+f(A)), wherein B1 is a first duty cycle adjustment coefficient, and B1>1, f(A) is a correction function using the average pixel brightness A as a variable.

9. The backlight brightness adjustment apparatus according to claim 8, wherein, the duty cycle adjustment unit further comprises:

a second adjustment subunit, configured to: in the second brightness range, seta second duty cycle P2 of the backlight source to be equal to B2*M, wherein B2 is a second duty cycle adjustment coefficient, and 1<B2<2; and a third adjustment subunit, configured to: in the third brightness range, set a third duty cycle P3 of the backlight source to be a maximum duty cycle of the backlight source.

10. The backlight brightness adjustment apparatus according to claim 9, wherein, the first adjustment subunit is further configured to: when an input frame is a 100% dark burst frame, turn off the backlight source, wherein the first duty cycle P1 of the backlight source is equal to 0.

11. The backlight brightness adjustment apparatus according to claim 2, wherein, the acquiring module is specifically configured to divide the backlight area of the LCD into the multiple sub-areas, detect pixel brightness of each sub-area, and acquire maximum pixel brightness M of a light-emitting diode (LED) in each sub-area according to an input frame; and sum up the maximum pixel brightness M of all the sub-areas and calculate an average value, and use the average value as the average pixel brightness A.

12. The backlight brightness adjustment apparatus according to claim 11, wherein, the control module is specifically configured to: when controlling the illumination brightness of each sub-area by using the adjusted duty cycle, store the adjusted duty cycle in at least one drive IC register, and output, by using the drive IC register, a waveform signal corresponding to the duty cycle to control the illumination brightness of each sub-area.

* * * * *